US005128653A

United States Patent [19]

Yuchi

[11] Patent Number: 5,128,653

[45] Date of Patent: Jul. 7, 1992

[54] FIRE ALARM SYSTEM

[75] Inventor: Sadataka Yuchi, Kanagawa, Japan

[73] Assignee: Hochiki Corporation, Tokyo, Japan

[21] Appl. No.: 798,826

[22] Filed: Nov. 22, 1991

Related U.S. Application Data

[63] Continuation of Ser. No. 678,890, Mar. 28, 1991, abandoned, which is a continuation of Ser. No. 566,857, Aug. 10, 1990, abandoned, which is a continuation of Ser. No. 427,468, Oct. 26, 1989, abandoned.

[30] Foreign Application Priority Data

Oct. 31, 1988 [JP] Japan ..... 63-274977

[51] Int. Cl.[5] ..... G08B 29/00

[52] U.S. Cl. ..... 340/506; 340/505; 340/511; 340/514; 340/518; 340/588; 340/870.21; 340/825.08; 364/141

[58] Field of Search ..... 340/506, 505, 514, 510, 340/511, 517, 521, 588, 589, 825.06, 825.08, 825.54, 870.16, 870.17, 870.21; 364/141, 138, 139, 140

[56] References Cited

U.S. PATENT DOCUMENTS

| | | | |
|---|---|---|---|
| 3,964,018 | 6/1976 | Strait et al. . | |
| 4,555,695 | 11/1985 | Machida et al. | 340/514 |
| 4,727,359 | 2/1988 | Yuchi et al. | 340/511 |
| 4,733,224 | 3/1988 | Kimura | 340/505 |
| 4,785,284 | 11/1988 | Kimura | 340/511 |

*Primary Examiner*—Donnie L. Crosland
*Attorney, Agent, or Firm*—Michael N. Meller

[57] ABSTRACT

A fire alarm system in which an analog type sensor (3) is connected to a transmission line (2) from a receiver (1) and in which one or more on-off type sensor (7) located in the same monitor area (14, 15, 16) as that in which the analog type sensor (3) is provided is connected to a signal line (6) led out from the analog type sensor (3). The analog type sensor (3) is provided with a fire detection circuit (12) for detecting a fire signal from the on-off type sensor (7) and a transmission control circuit (11) for transmitting its own analog detection data and fire detection data from the fire detection circuit (12) to the receiver (1).

3 Claims, 4 Drawing Sheets

FIRE ALARM SYSTEM

This application is a continuation of application Ser. No. 678,890, filed Mar. 28, 1991 now abandoned, which is a continuation of application Ser. No. 566,857, filed Aug. 10, 1990 now abandoned, which is a continuation of application Ser. No. 427,468, filed Oct. 26, 1989 now abandoned.

BACKGROUND OF THE INVENTION

1. Field of the Invention

This invention relates to a fire alarm system and, more particularly, to a fire alarm system including a receiver having the function of detecting a fire based on analog detection data contained in a received signal, at least one analog type sensor provided in at least one monitored area monitored by the receiver, in combination with one or more on-off type sensor, and a transmission line interconnecting the analog type and on-off type sensors and the receiver.

2. Description of the Prior Art

Such system the fire alarm system, such system in which a plurality of so-called on-off type sensors each having a switching element which is turned on in case of fire detection are connected to a transmission line from a receiver, is most popular. This on-off type sensor senses changes in the surrounding physical phenomena caused by the fire, such as those in the temperature or smoke concentration. When the magnitude of the changes exceeds a predetermined threshold value, the switching element is actuated to transmit fire alarm signals or, more precisely, current signals, to the receiver over the transmission line. In short, with the on-off type sensor, it is the sensor itself that decides whether or not the fire has broken out.

On the other hand. a fire alarm system has been evolved in which it is not the sensor itself, as in the on-off type sensor, but the receiver, that has the function of determining whether or not the fire has broken out. In this case, an analog type sensor, which senses the extent of the changes in the surrounding physical phenomena caused by the fire as an analog value, is used as the sensor. The analog detection signal outputted from the sensor is transmitted over the transmission line to the receiver where it is determined from the received analog detection data whether or not the fire has broken out.

With such analog fire alarm system, since the receiver gives a judgment as to the possible occurrence of a fire, it becomes possible to perform ingenious signal processing, such as predictive judgment on the fire occurrence. Also, since the analog data itself is handled, a mistaken fire report, such as is often made by the on-off type sensor, cannot be made, so that early fire detection can be achieved with the minimum risk of mistaken signalling.

With such analog fire alarm system, it becomes necessary to distinguish output analog data from a plurality of analog type sensors connected to the same transmission network. For this reason, an address is set for each of the analog type sensors and each sensor is adapted to sequentially transmit its own analog detection data to the receiver over the transmission line by time divisional multiplexed transmission according to a polling system. In this case, a reset pulse and a plurality of clock pulses are transmitted at a predetermined time interval from the receiver to the analog type sensors. The clock pulses start to be counted at the sensor from the time when the reset pulse is received. When the count value reaches the clock count allocated to a specific receiver, it is determined that the receiver has been interrogated, and the analog detection data contained in the receiver at this time is sent to the receiver after conversion into a corresponding electrical current value.

However, in such conventional analog fire alarm system, since the sensors are sequentially interrogated by relying upon the addresses allocated thereto, the time period involved in interrogating the sensors, that is the polling period, is necessarily increased with the increase in the number of the sensors. The result is that limitations are imposed on the number of the sensors that can be interrogated within a predetermined time period within the allowable limit of the delay in fire detection and hence on the number of the sensors that can be provided in each network.

Thus, in a monitor area of a larger spatial capacity, such as a large hall, it occurs frequently that the number of the sensors to be installed exceeds the allowable limit per network, with the result that plural analog sensor networks need be installed in one and the same monitor area by means of receivers or relays with complicated layout and increased costs.

On the other hand, provision of an address sensor in one monitor area results in increased costs and a complicated control operation at the receiver on fire occurrence with a corresponding broad application to the control section.

SUMMARY OF THE INVENTION

In view of the above mentioned problems of the prior art system, it is a principal object of the present invention to provide a fire alarm system in which the number of the installed analog type sensors can be mimimized and yet the monitoring function comparable with the case in which the analog type sensors are installed in all of the monitor areas may be achieved, and in which the system setup may be simplified at lower costs.

For accomplishing the above object, the present invention provides a fire alarm system comprising a receiver having the function of detecting a fire based on analog detection data contained in a received signal, at least one analog type sensor provided in at least one monitor area monitored by the receiver, in combination with one or more on-off type sensor, and a transmission line interconnecting the analog type sensor-on-off type sensor combination and the receiver. The analog type sensors transmits analog detection data proportionate to changes in surrounding physical phenomena caused by the fire, while the on-off type sensor is switched when the changes in the surrounding physical phenomena exceed a preset threshold value to transmit fire signals over the transmission line. The analog type sensor is connected to the transmission line, and a separate signal line is led out from the analog type sensor. One or more on-off type sensors provided in the same monitor area as the analog type sensor is connected to the signal transmission line. The analog type sensor includes analog detection means for outputting analog detection data proportionate to changes in the surrounding physical phenomena caused by the fire, fire detection means for detecting fire signals from the on-off type sensor and transmission control means for transmitting signals containing the analog detection data from the analog detection means and the data concerning the presence or absence of the fire detection signals from the fire detection means.

According to a preferred embodiment of the present invention, the analog type sensor includes a mounting base section fixedly provided to a ceiling or wall surface of a building and a detection head section detachably mounted to the mounting base section. The fire detection means and the transmission control means are provided in the mounting base section and the analog detection means are provided in the detection head section.

With the above described fire alarm system of the present invention, the sensors are grouped in plural sets each consisting of an analog sensor and one or more on-off type sensors connected in common to a signal line led out from the analog type sensor.

Thus the number of the analog type sensors in need of address setting can be reduced markedly, such that only one analog sensor circuit or network suffices to get the sensors connected in their entirety to the receiver even for a broader monitor area.

When a plurality of the on-off type sensors are installed around the analog type sensor, the state of the progress of a fire at the mounting sites of the surrounding on-off type sensors can be judged to some extent by the sole analog type sensor for the monitored area covered by the same group of the sensors, so that the fire discerning function proper to the analog type sensor can be displayed to the maximum extent possible. The site of the fire can also be located from the addresses allotted to the sensors.

According to the present invention, as described hereinabove, the number of address settings based on which interrogations from the receiver are made may be drastically reduced even for a broader monitor area, such as a large hall, where a large number of the sensors has to be installed, since the address setting can be made with the sole analog type sensor and the associated on-off type sensor or sensors as one group. Also, since the group can be identified by the address allocated to the analog type sensor, the site of fire can be located promptly so that measures can be taken at an earlier time. Since one of the sensors of a group of sensors is necessarily an analog type sensor, the detailed state of the monitor area covered by a group of the sensors, such as the smoke or temperature, can be grasped, so that a more satisfactory fire monitoring function can be displayed as compared with the system employing only the on-off type sensors.

In addition, the number of the installed analog type sensors can be reduced significantly as compared to the system employing only the analog type sensors, so that the system construction inclusive of the control function by the receiver can be simplified with reduction in equipment costs.

The above and other objects and features of the present invention will become more clear from the following description of the preferred embodiment of the invention especially when read in conjunction with the accompanying drawings.

DESCRIPTION OF THE PREFERRED EMBODIMENTS

Figure 1:
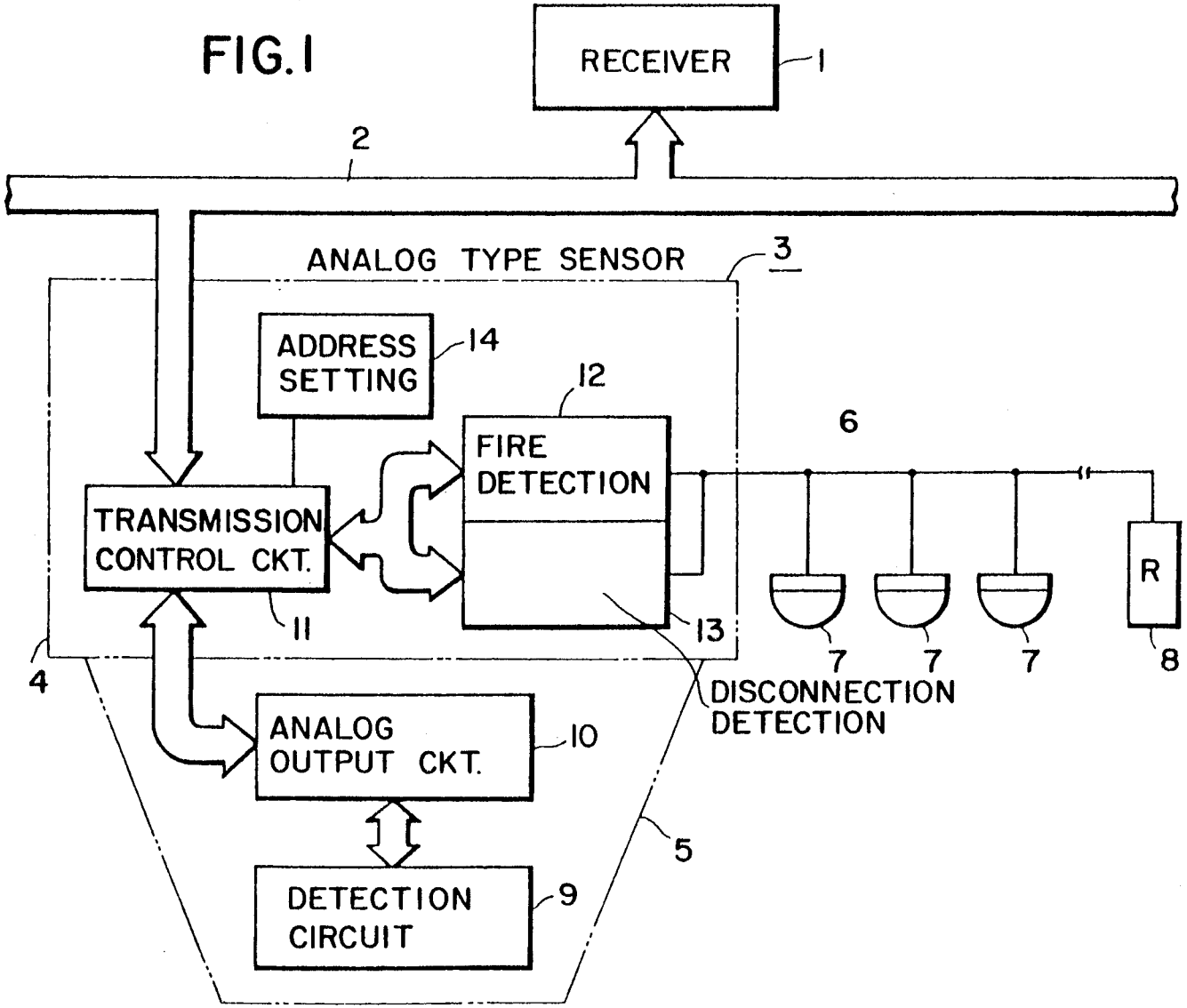
FIG. 1 is a block diagram showing an embodiment of the present invention.

FIG. 1 is a block diagram showing an embodiment of the present invention.

Referring to this figure, an analog type sensor 3 is connected to a transmission line 2 which is led out from a receiver 1 and which is adapted to perform as a power supply to the system and to effect signal transmission.

The analog type sensor 3 is made up of a base section 4 and a head section 5. The head section 5 is provided with a detection circuit 9 for analog detection of changes in certain physical phenomena, such as smoke concentration, caused by a fire. The analog data detected by the circuit 9 are supplied via an analog output circuit 10 to the base section 4.

The base section 4 is provided with transmission control circuit 11 for converting the analog detection data from the analog output circuit 10 of the head section 5 into electrical current signals and transmitting the electrical current signals over the transmission line 2 to the receiver 1.

The transmission control circuit 11 provided in the base section 4 is responsive to polling control signals from the receiver 1 to transmit analog detection data from the output circuit 10 in the current mode on being interrogated.

More specifically, the receiver 1 repeatedly performs an interrogating operation of sending out plural clock pulses to the transmission line 2 after sending out a reset pulse. The control circuit 11 clears a counter, not shown, with the reset pulse transmitted from the receiver 1 over line 2 and counts the clock pulses following the reset pulse. When the count of the clocks coincides with a preset address set in the analog type sensor 3, that is, a predetermined count, the circuit 11 decides that it is being interrogated and converts the analog detection data from the head section 5 into a corresponding electrical current which is sent to the receiver 1. For making this decision, an address setting unit 14 is provided in the control circuit 11.

The base section of the analog type sensor 3 is provided with a fire detection circuit 12 from which a signal line 6 serving simultaneously as a power supply line is led to the outside. A plurality of on/off type sensors 7 are connected to the signal line 6, to the terminal part of which a terminal resistor 8 for disconnection detection is connected.

Each on-off type sensor 7 is switched when the change in a physical parameter by a fire exceeds a predetermined threshold to emit a fire signal in a known manner. Thus the sensor 7 itself has the function of determining the occurrence of a fire. More specifically, the on/off type sensor 7 sends out on fire detection an alarm current over the signal line 6 by a switching operation. This alarm current is detected by the fire detection circuit 12 provided in the base section 4 of the analog type sensor 3 so as to be transmitted to the control circuit 11.

A disconnection detection circuit 13 is provided in the base section 4 in association with the signal line 6 led out from the detection circuit 12. The disconnection detection circuit 13 senses that the disconnection monitoring current flowing in the terminal resistor 8 is interrupted due to disconnection of the signal line 6 to output a disconnection detection signal to the transmission control circuit 11.

Thus the control circuit 11 provided in the base section 4 has, in addition to the function of transmitting the analog detection data from the output circuit 10 of the head section 5 to the receiver 1, the function of transmitting the fire detection signal from the circuit 12 or the disconnection detection signal to the receiver 1 after conversion from the circuit 13 into electrical currents, similarly to the analog detection signal.

Figure 2:
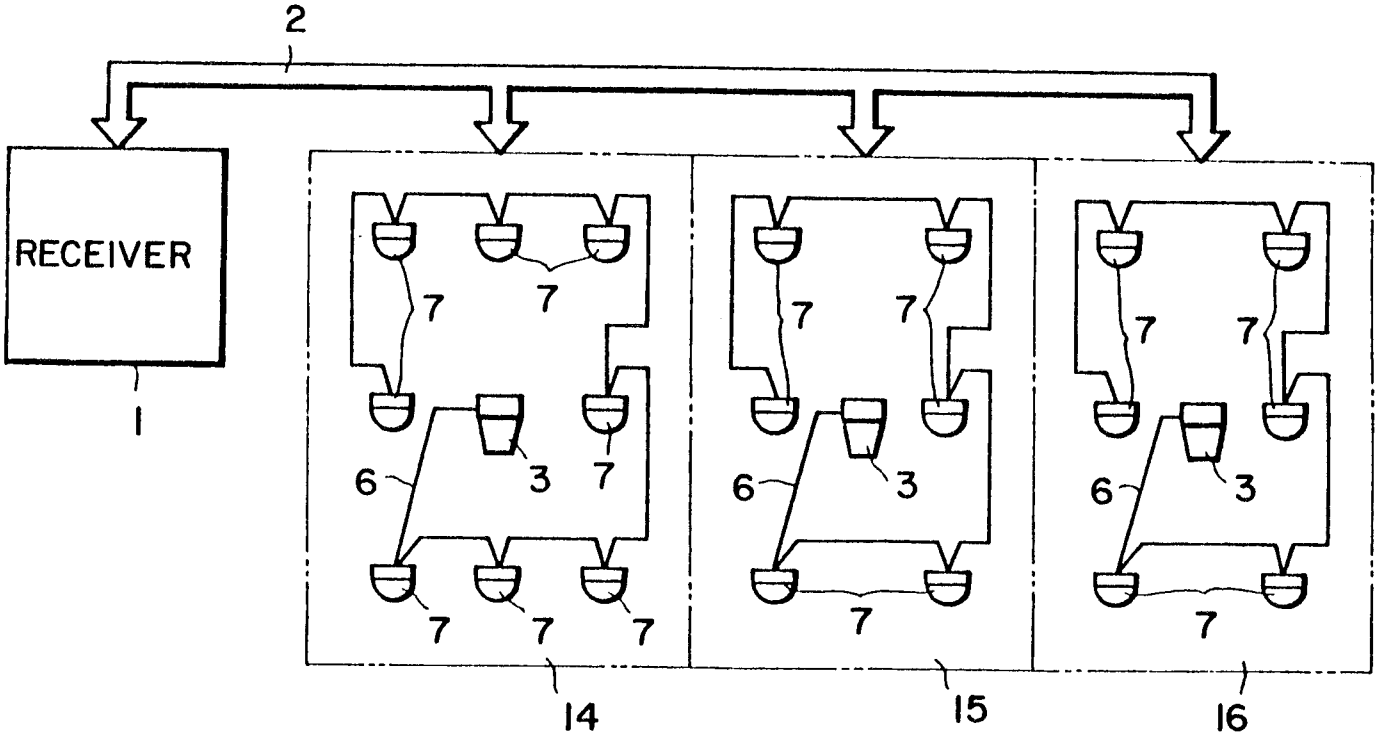
FIG. 2 is an illustrative view showing a mounting example of the sensors according to the present invention.

FIG. 2 is an explanatory view showing a mounting example of the sensors in an monitoring area covered by the fire alarm system of the present invention.

In this figure, the receiver 1 covers three monitoring areas 14, 15, 16, in each of which seven to nine sensors, for example, need be provided as a function of the surface measure of the areas 14 to 16.

For each of these monitor areas 14 to 16, there are provided in the fire alarm system of the present invention an analog type sensor 3 at, for example, the center of each of the areas 14 to 16, and a plurality of on-off type sensors 7 around the analog type sensor 3. The on-off type sensors 7 of each of the areas 14 to 16 are connected to the signal line 6 led from the fire detection circuit 12 in the base section 4 of the analog type sensor 3, for each of the areas 14 to 16.

With the sensor disposition and connection for each of the areas 14 to 16 of the fire alarm system according to the present invention, it is necessary to provide three addresses for the receiver 1 to make interrogations. If the system of the same scale is constituted as the prior-art system, all of the sensors are the analog type sensors, so that address setting is necessary for each sensor and hence twenty-three addresses are necessary for the three monitor areas 14 to 16. Conversely, the number of the necessitated addresses is reduced drastically to three in the embodiment of FIG. 2.

In as much as the analog type sensor 3 capable of collecting detailed fire data is provided at the center of each of the monitor areas 14 to 16, and the on-off type sensors 7 are placed there around, detailed fire data such as smoke or temperature caused by fire in the detection regions of the peripherally disposed on-off type sensors 7 may be roughly grasped by the centrally disposed analog type sensor 3.

For example, when the fire is detected by one of the on-off type sensors 7 in the monitor area 14, analog detection data such as smoke concentration is obtained by the centrally disposed analog type sensor 3 and displayed in the receiver to allow the understanding of the state of progress after the start of the fire in the monitor area 14 by the receiver 1.

The operation of the embodiment shown in FIG. 1 is explained with reference to a timing chart of FIG. 3 and a flow chart for the analog type sensor of FIG. 4.

During steady-state monitoring, the receiver 1 performs a repetitive operation of sending out over the transmission line 2 a reset pulse followed by clock pulses A1, A2, A3, A4,—for determining sensor interrogating addresses.

Figure 4:
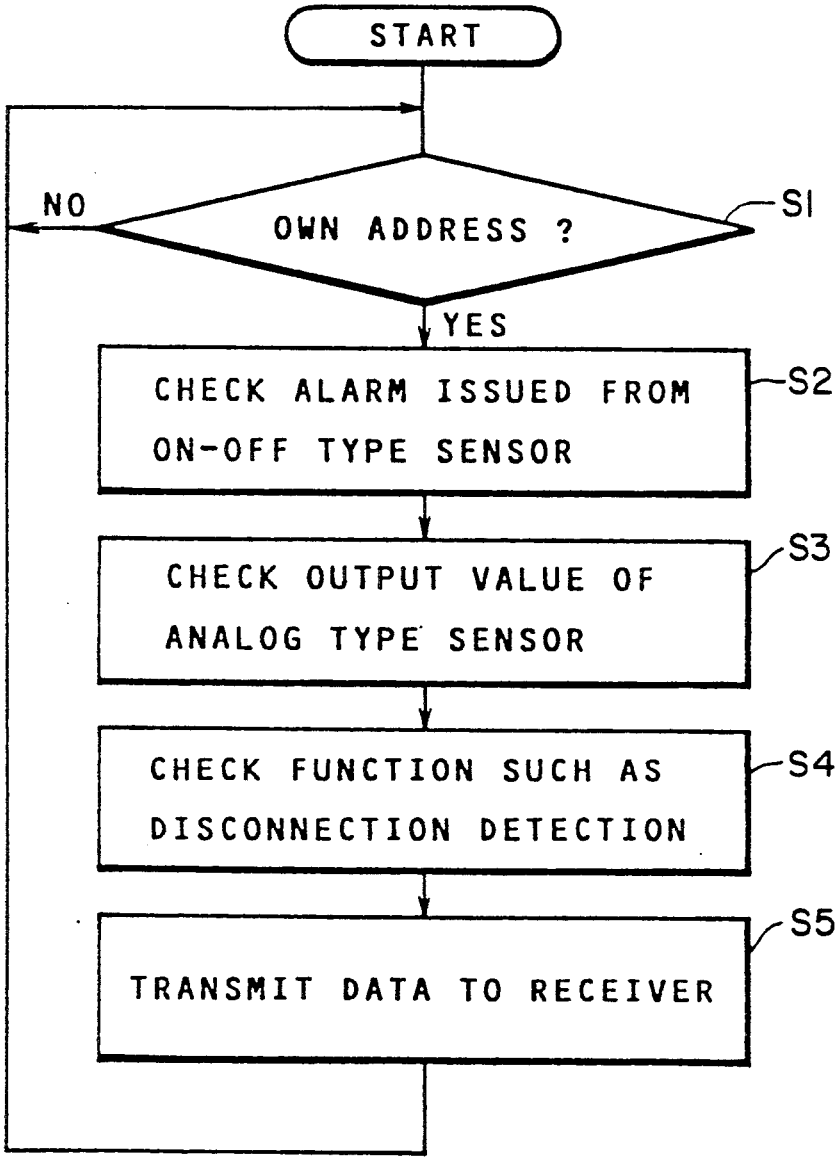
FIG. 4 is a flow chart showing the operational flow at the side of sensors in the embodiment shown in FIG. 1.

As shown by the flow chart of FIG. 4, the transmission control circuit 11 provided in the base section 4 of the analog type sensor 3 is responsive to the interrogation by the clock pulses from the receiver 1 to count the clock pulses from the receiver at step S1 to decide if the count coincides with a preset own address. If the count is decided at step S1 to be the preset address, the program proceeds to step S2 where it is first checked whether an alarm is issued from the on/off type sensor 7, that is, whether the fire detection output is issued from any of the on-off type sensors 7 connected by the fire detection circuit 12 to the signal line 6.

The program then proceeds to step S3 where an analog output value of the detection circuit 9 from the analog output circuit 10 provided in the head section 5 is checked.

The program then proceeds to step S4 where it is checked whether a disconnection detection output is issued from the detection circuit 13 provided in the base section 4.

The program then proceeds ultimately to step S5 where the results at the steps S2, S3 and S4, that is, the functional check outputs such as the presence or absence of detection data from the on/off type sensors, analog detection data by the analog type sensor or the disconnection, are converted into electrical currents for transmission to the receiver.

Figure 3A:
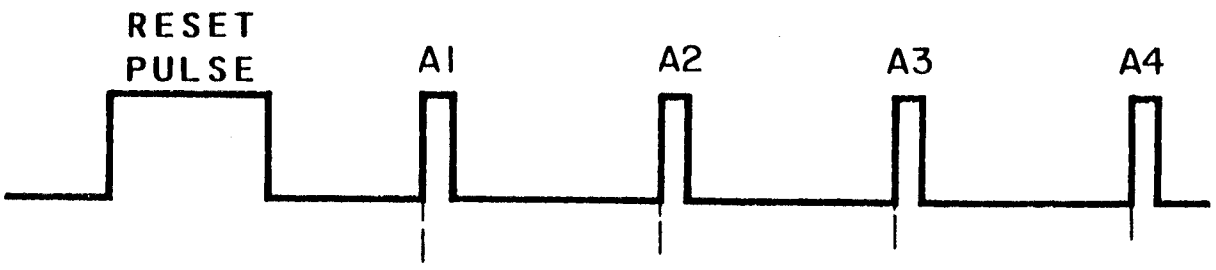
FIG. 3 is a signal timing chart showing the state of interrogation of and response by the sensors in the embodiment of FIG. 1.
Figure 3B:
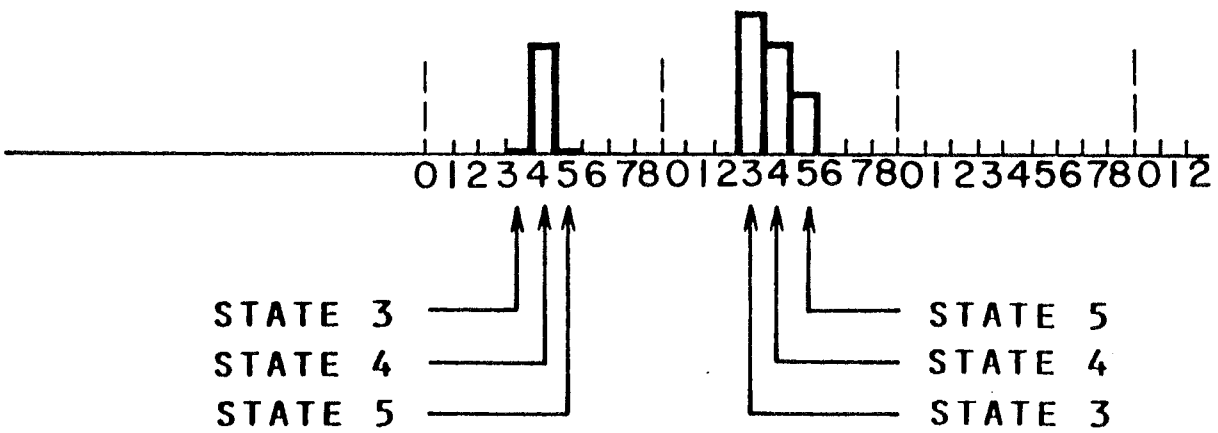

Data transmission from the analog type sensor 3 to the receiver 1 with the current mode at step S5 is performed as indicated by the terminal response current shown in FIG. 3*b*.

Turning to the response current from the analog type sensor, with the clock pulse A1 of FIG. 3*a* having been decided to coincide with the preset address, nine states 0 to 8 are set in the present embodiment during the time interval commencing with the reception of the clock pulse A1 until the reception of the clock pulse A2. The flame detection data issued by the on/off type sensor is sent out at the timing of the state 3 after conversion into corresponding electrical currents, the analog detection data is sent out at the timing of the state 4 after conversion into corresponding electrical currents and the check data such as disconnection data are sent at the timing of the state 5 after conversion into corresponding electrical currents. Thus the issued state of he terminal response current following the reception of the clock pulse A1 indicates that the on/off type sensor is turned off at state 3, thus indicating no alarm having been issued, that the value of the analog detection data is as shown at state 4 and that the there is no functional check output such as disconnection output at state 5 so that the response current is zero.

Turning to the states 3 to 5 as the response current from another analog type sensor which has decided that the count of the next clock A2 coincides with its own preset address, the on-off type sensor is turned on at state 3, that is, an electrical current indicating an alarm is sent out, the value of analog detection data is as indicated at step 4 and the current is issued at step 5 indicating that check data such as disconnection have been produced.

In the above described fire alarm system, an alarm area covered by an analog type sensor with a pre-set address and a number of on-off type sensors connected in common to the analog type sensor is interrogated as one set or group by the receiver and the functional check data such as the analog detection data, on-off detection data or disconnection relating to the on/off sensors are collected from the set or group of the analog type sensor and the on-off type sensors.

Although the present invention has been described and illustrated in detail, it is to be clearly understood that the same in by way of illustration and example only and is not to be interpreted in the limiting sense.

What is claimed is:

1. A fire alarm system for detecting a fire condition in a plurality of monitor areas, comprising:

a plurality of sensor combinations respectively located in said monitor areas and each of which includes an analog type sensor adapted to produce analog detection data corresponding to changes in a surrounding physical phenomenon caused by the fire in response to a polling signal received thereby and one or more on-off type sensors connected to said analog type sensor and adapted to produce a fire signal when the changes in the surrounding physical phenomenon exceed a preset threshold value;

a receiver adapted to poll said analog type sensor in each of said sensor combinations sequentially and to detect a fire based on said analog detection data contained in a response signal from said analog type sensor;

a transmission line interconnecting said receiver and said analog sensor in each of said sensor combinations for transmitting said polling signal and said response signal; and said analog type sensor including analog detection means for producing said analog detection data, fire detection means for detecting said fire signal from said on-off type sensor connected thereto and transmission control means for transmitting said response signal containing said analog detection data from said analog detection means and the data concerning the presence or absence of said fire signal from said fire detection means in response to said polling signal from said receiver.

2. A fire alarm system according to claim 1 wherein said analog type sensor includes a mounting base section fixedly provided on a ceiling or wall surface of a building and a detection head section detachably mounted to said mounting base section, said fire detection means and said transmission control means being provided in said mounting base section and said analog detection means being provided in said detection head section.

3. A fire alarm system according to claim 1 wherein said analog type sensor further includes disconnection detection means detecting disconnection of a signal line, interconnecting said analog type sensor and said on-off type sensor said transmission control means being adapted to transmit said response signal containing data relating to the presence or absence of disconnection detection signals from said disconnection detection means over said transmission line to said receiver.

* * * * *